US005890121A

United States Patent [19]

Borcherding

[11] Patent Number: 5,890,121

[45] Date of Patent: Mar. 30, 1999

[54] LIGHT-WEIGHT ADHESIVE AUDIO AND WRITTEN NOTE RECORDING DEVICE

[75] Inventor: Mark A. Borcherding, Austin, Tex.

[73] Assignee: Texas Instruments Incorporated, Dallas, Tex.

[21] Appl. No.: 990,144

[22] Filed: Dec. 14, 1992

[51] Int. Cl.[6] ..... G10L 3/02

[52] U.S. Cl. ..... 704/272; 704/270; 704/278

[58] Field of Search ..... 360/39, 72.1; 340/825.31; 381/49, 51; 395/2, 2.1, 2.76, 2.8, 2.79, 2.81, 2.83, 2.82, 2.84; 704/270, 272, 287

[56] References Cited

U.S. PATENT DOCUMENTS

| | | | |
|---|---|---|---|
| 4,389,541 | 6/1983 | Nakano et al. | 381/51 |
| 4,453,161 | 6/1984 | Lemelson | 340/825.31 |
| 4,841,387 | 6/1989 | Rindfuss | 360/72.1 |
| 4,908,866 | 3/1990 | Goldwasser et al. | 395/2.1 |
| 5,008,942 | 4/1991 | Kikuchi | 395/2.79 |
| 5,045,327 | 9/1991 | Tarlow et al. | 381/51 |
| 5,161,199 | 11/1992 | David | 381/51 |
| 5,193,141 | 3/1993 | Zwern | 395/2 |
| 5,339,203 | 8/1994 | Henits et al. | 360/39 |

*Primary Examiner*—Tariq R. Hafiz
*Attorney, Agent, or Firm*—Ronald O. Neerings; Robby T. Holland; Richard L. Donaldson

[57] ABSTRACT

A light-weight adhesive note recording device (12) records sounds (22) and written text (20) and attaches to a plurality of different types of surfaces (14). Recording circuitry (34) receives and records sounds (22) as a plurality of digital signals. Memory circuitry (38) stores digital signals, and speaker circuitry (40) plays back digital signals as recordings of sounds (22). Control circuitry (36) controls operation of recording circuitry (34), memory circuit (38), and speaker circuitry (40). Power source (44) provides power to operate recording device (12). Text surface (26) is used for writing or printing written text or message (20). Adhering mechanism (54) adheres recording device (12) to a wide variety of surfaces (14). Recording device (12) has sufficiently small size and a flat writing or text surface (26) for repeated use as an adhesive note recording device.

25 Claims, 3 Drawing Sheets

FIG. 9a
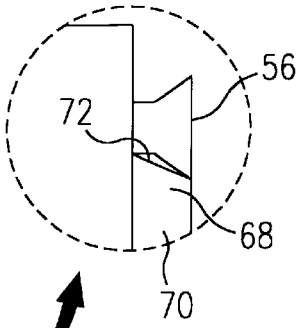
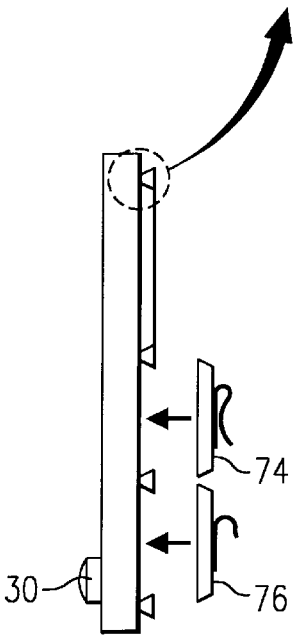
FIG. 9
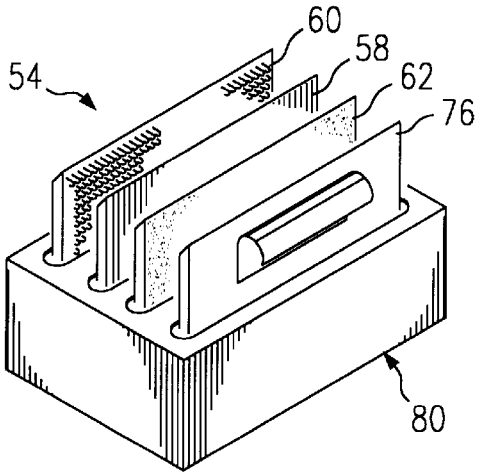
FIG. 10
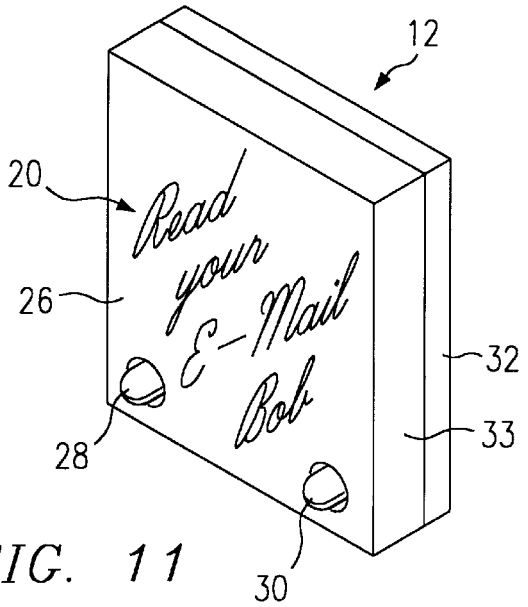
FIG. 11

LIGHT-WEIGHT ADHESIVE AUDIO AND WRITTEN NOTE RECORDING DEVICE

TECHNICAL FIELD OF THE INVENTION

The present invention relates generally to electronic systems for recording various sounds and, more particularly, to a light-weight audio and written note recording device for recording and communicating sounds and written text and adhering to a wide variety of surfaces.

BACKGROUND OF THE INVENTION

In a variety of environments, it is advantageous for people to communicate with notes such as those of the Post-it™ note variety. This permits simply jotting down a note and communicating information from the sender to a recipient. The Post-it™ note will then removably adhere to certain surfaces so that the sender can communicate the information to the recipient. The use of Post-it™ type notes has wide application, but there are numerous circumstances in which Post-it™ notes are not useful to communicate important notes or information from a sender to the recipient.

One problem of such note-taking or communicating devices is their writing space limitation. For example, Post-it™ type notes typically are available commercially in only a few different sizes. These sizes are not always helpful to convey extensive or complex notes. When a sender needs to convey more extensive notes, he reverts to using multiple notes. The use of multiple Post-it™ notes, however, can lead to confusion and still may not effectively convey the sender's message. Another limitation of a Post-it™ note is the need for a pen or writing utensil to write the message for the recipient. There are some instances where the sender does not have such writing utensils, but still urgently needs to leave a message. In such instances, Post-it™ notes are virtually useless.

Yet another limitation of these types of note communication devices is that they have simply a removably adhering strip on their reverse side. While the strip may comfortably adhere to paper and other flat surfaces, the Post-it™ note does not effectively adhere to some fabric surfaces or to highly porous surfaces.

Another significant limitation with all written note communication devices is there inability to communicate from a sender to a recipient certain information such as emphasis or sounds that are important to the information that the sender desires to communicate.

A further limitation of conventional note recording devices is that they waste or use up significant amounts of paper. Once a Post-it™ note is used, it typically is thrown away. Thus, businesses often use tons of Post-it™ and other types of notes on a yearly basis. If there were a way to use a recyclable device for communicating notes, we could preserve significant natural resources.

Thus, there is need for a note communication device that is not restricted by the size limitations of conventional note communication devices.

There is a need for a note communication device that adheres easily to a wide variety of surfaces.

There is a further need for a note communication device that permits the sender to easily convey emphasis or to communicate sounds that would be important to the recipient.

There is a need for a note recording device that is recyclable and that conserves natural resources.

Furthermore, a need has arisen for a light-weight adhesive note recording device for recording a wide variety of sounds and written text and attaching to a numerous types of surfaces.

SUMMARY OF THE INVENTION

The present invention, accordingly, provides a light-weight adhesive note recording device that substantially eliminates or reduces disadvantages and limitations associated with prior note recording devices by permitting not only numerous handwritten or other textual notes to be recorded, but also by permitting recording of sounds and that attaches to a wide variety of surfaces.

One aspect of the present invention is a light-weight adhesive note recording device that records sounds and written text and that attaches to a plurality of different types of surfaces. The adhesive note recording device of the present invention includes recording circuitry for receiving and recording sounds as a plurality of digital signals. The device includes a memory for storing the digital sounds as well as speaker circuitry for playing the digital signals as recordings of the sounds. Control circuitry of the recording device controls operation of the recording circuitry, the memory circuit, and the speaker circuitry. The power source provides the necessary power to operate the recording device. In addition, the recording device of the present invention includes a written note recording surface for writing or printing text that may, for example, relate to the sounds that the device records. An adhering mechanism adheres the recording device of the present invention to a wide variety of surfaces. The recording device of the present invention has sufficiently small size for repeated use and positioning on a wide variety of surfaces by simply adhering to the surface.

The light-weight adhesive sound and note recording device of the present invention has numerous technical advantages. For example, the combination of the written text and audio sounds or recorded notes provides to the sender a much more complete way of expressing his or her thoughts.

Another advantage that the recording device of the present invention provides is a wide variety of adhering mechanisms that conventional notes or Post-it™ type notes do not provide. Thus, the sender may adhere the recording device to a smooth surface, a rough surface, a fabric surface, a magnetically responsive surface, or a wide variety of other surfaces that traditional notes using the Post-it™ note or similar concepts can not accommodate.

Another technical advantage of the note recording device of the present invention is that, because it permits recording sound, not only can the recipient interpret emphasis that the sender may seek to express, but also the recipient gets a voice signature of sender. This can be very important for later identification or verification of the sender's identity. Additionally, sounds such as machine noises or sirens or other types of noises that simply cannot be conveyed effectively by only written text can be communicated by the sound and note recording device of the present invention.

Another technical advantage of the present invention is that it has a wide variety of uses other than as a handwritten note recording device. For example, the recording device may be used as a business card or as an instruction label that "talks" to the recipient. There are numerous possible applications for combining the audio playback feature of the present invention with written text or printed text. The preferred embodiment is also advantageous in that it does not require a pen or other writing utensil to leave a message. By simply pressing a record button 28 on the recording device, a person may leave a message for the recipient who may later press a play button and receive the message.

One more technical advantage of the present invention is that it is fully recyclable. Handwritten notes and devices such as those of the Post-it™ note variety are wasteful in the sense that once they are used they are thrown away. The recording device of the present invention on the other hand, may be used repeatedly for recording and playing back messages between senders and recipients.

BRIEF DESCRIPTION OF THE DRAWINGS

The invention and its modes of use and advantages are best understood by reference to the following description of illustrative embodiments when read in conjunction with the accompanying drawings, wherein:

FIG. 9 further illustrates the various adhesive panels for use with the preferred embodiment; and FIG. 10 shows a possible storage case for the various adhesive panels of the preferred embodiment.

FIG. 11 shows a more detailed isometric view of another embodiment of the invention.

DETAILED DESCRIPTION OF THE INVENTION

The preferred embodiment of the present invention is best understood by referring to the FIGURES, wherein like numerals are used for like and corresponding parts of the various drawings.

Figure 1:
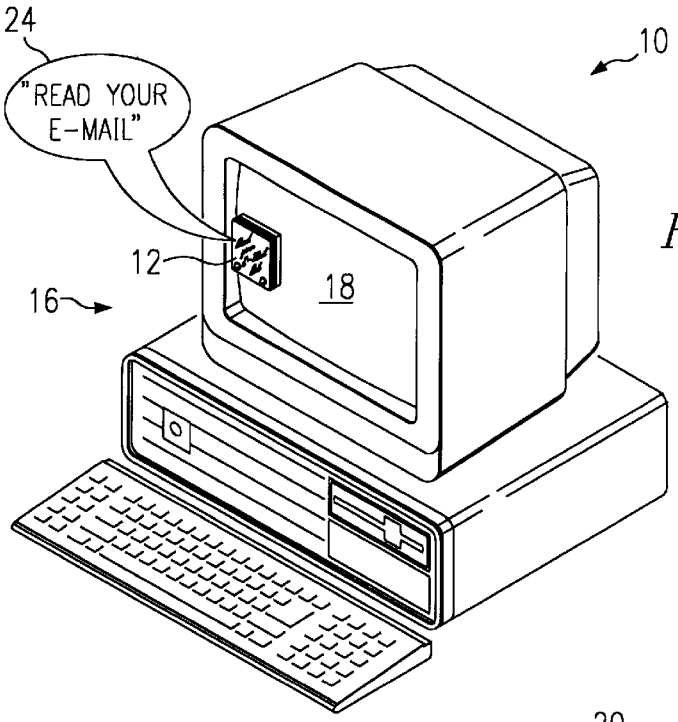
FIG. 1 provide a view of the adhesive note recording device of the preferred embodiment in use in an exemplary environment.
Figure 2:
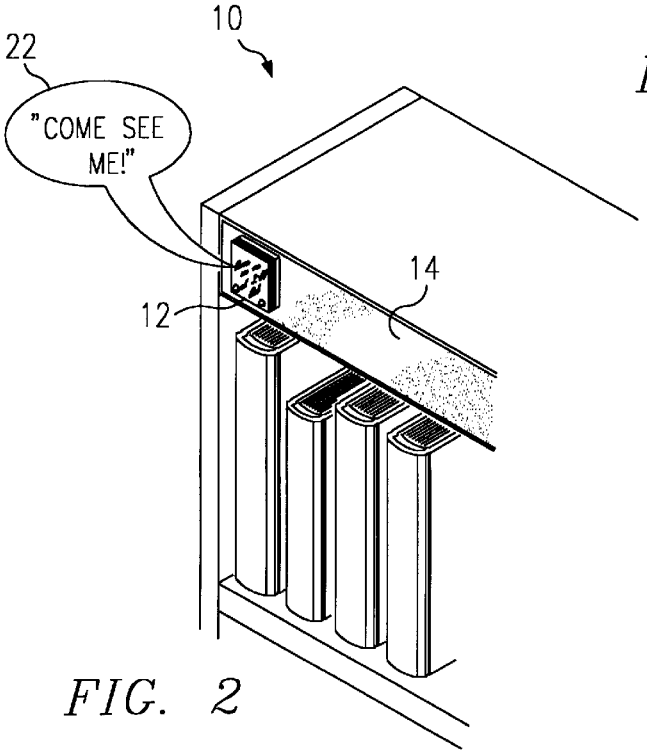
FIG. 2 provides a view of the adhesive note recording device of the preferred embodiment in use in another exemplary environment.

Exemplary environments 10 in FIGS. 1 and 2 illustrate the use of light-weight adhesive sound and note recording device 12 of the present invention. For example, recording device 12 may be attached to fabric-covered bookcase front 14, as shown in FIG. 2 or on computer 16 at monitor screen 18, as shown in FIG. 1. In either application, recording device 12 may contain written text 20 and provide an audible message such as the audible "Come See Me" message 22 or the "Read Your E-Mail" message 24 or any type of message whatsoever that a sender may want to communicate to a recipient.

Figure 3:
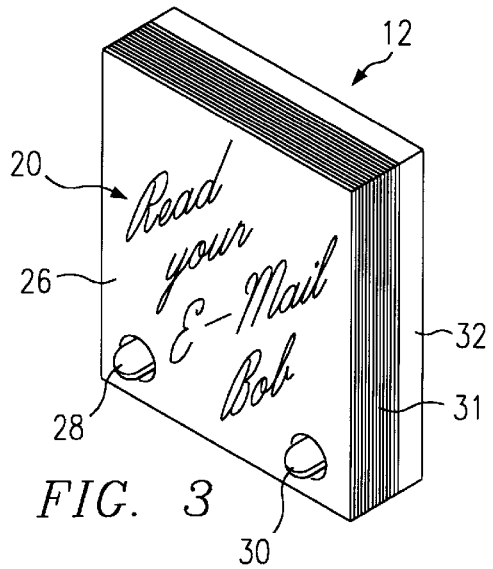
FIG. 3 shows a more detailed isometric view of a preferred embodiment.

FIGS. 3 and 11 show a closer isometric view of light-weight adhesive sound and note recording device 12 of preferred embodiments of the invention. Recording device 12 includes writing surface 26 on which to write handwritten notes. Record button 28 controls recording circuitry within recording device 12. Play button 30 controls a speaker circuit and other related circuitry within device 12 for playing previously-recorded messages. One embodiment of the invention may include a plurality of sheets of paper 31 that form a pad of writing surfaces as shown in FIG. 3. The individual sheets may be associated so that they can be torn off after use to leave a clean surface on which to write. In another embodiment, shown in FIG. 11, writing surface 26 may be a white, slick surface 33 on which a writer can use erasable markers. Another portion of recording device 12 is electronic section 32 that includes the necessary circuitry and power supply for recording and playing back the sounds and audio notes.

Figure 4:
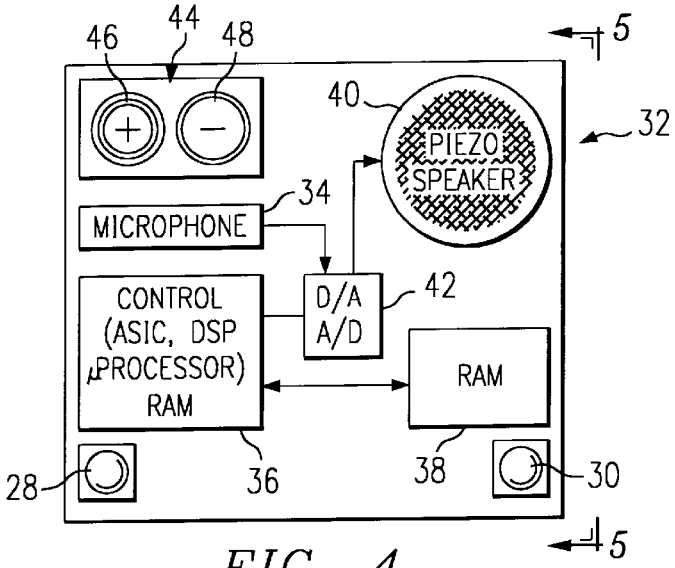
FIG. 4 shows a simplified block diagram of the circuit components of the present invention.

FIG. 4 provides a schematic block diagram of internal components of electronic portion 32 of recording device 12. For example, within electronic portion 32 is recording circuitry that includes microphone 34 that receives and provides recordable sound signals to control circuitry 36. Control circuitry 36 controls the operation of microphone 34 as well as RAM 38 and piezo-electric speaker 40. Control circuitry 36 also includes digital-to-analog/analog-to-digital converter 42 for converting analog signals from microphone 34 to digital signals for storing in RAM 38 and digital signals in RAM 38 for play by analog speaker circuit 40. To provide power to electronic portion 32, battery pack 44 may contain, for example, two small batteries 46 and 48 such as that found in many wristwatches. To provide the necessary control signals for recording, record button 28 connects to control circuitry 36. Control of speaker circuitry 40 and the associated circuitry for playing sound recordings of digital signals within RAM 38 is through the use of play button 30.

The components of recording device 12 including recording circuitry associated with and including microphone 34, memory circuit including ram 38, speaker circuitry including piezo-electric speaker 40, control circuitry including control circuitry 36, and digital-to-analog/analog-to-digital converter 42 are housed in a case, which, in the preferred embodiment, is 2"×2" or less in size.

Control circuitry 36 may be an application specific integrated circuit (ASIC), a digital signal processor such as the TMS320C10 digital signal processor manufactured by Texas Instruments or other processing circuitry sufficiently small and inexpensive for the purposes of the present invention. RAM 38 depends on the size of analog-to-digital/digital-to-analog converter 42. However, the preferred embodiment may use an 8-bit RAM that is simple and fits within the form factor of the preferred embodiment. Therefore, analog-to-digital/digital-to-analog converter 42 would use an 8-bit converter that is compatible with RAM 38. RAM 38 may be slow and could be a video RAM that may permit the recording of more than one message. Analog-to-digital/digital-to-analog converter 42 preferably has a sampling rate of between 4 KHz and 8 KHz. Battery pack 44 may also be a solar cell that provides sufficient power to drive all circuitry within electronic portion 42 of recording device 12. In estimating the necessary size of RAM 38, it may be important to understand that for 30 seconds of recording time at a sampling rate of 8 KHz, a 240K RAM is necessary. This amount of RAM storage is changeable depending on whether or not recording device 12 uses a data compression algorithm.

Figure 5:
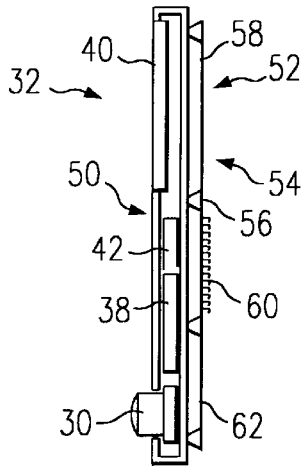
FIG. 5 shows a side view of the preferred embodiment to illustrate its approximate thickness.

A key aspect of the preferred embodiment is that it is sufficiently small to be portable and easily adhesive to surfaces such as a computer monitor screen or any type of surface where a traditional note or Post-it™ note might be used. FIG. 5 provides a side view consistent with the arrows of FIG. 4 that illustrates the thickness T of electronics portion 32 in the preferred. embodiment. For example, the side profile of FIG. 5 shows the thickness of electronics portion 42 and particularly points out the thickness of RAM 38 and speaker 40. Play button 30 protrudes only slightly from surface 50 of electronics portion 32. FIG. 5 also shows a side view of back panel 52 of the preferred embodiment including adhering mechanisms or panels designated generally by reference numeral 54 and engaging post 56 that protrude from and are integral to back portion 52. As FIG. 5 illustrates, adhesive mechanisms 54 may use different types of adhering mechanisms. For example, adhering mechanism 54 may be an adhesive panel 58, a velcro panel 60, or a magnetic panel 62. The type of panel will depend upon the surface to which light-weight adhesive sound and note recording device 12 is to adhere. An important aspect of the present invention, however, is that the type of adhering mechanism may be selected from a wide variety of adhering methods or techniques for use on an anticipated surface.

Figure 6:
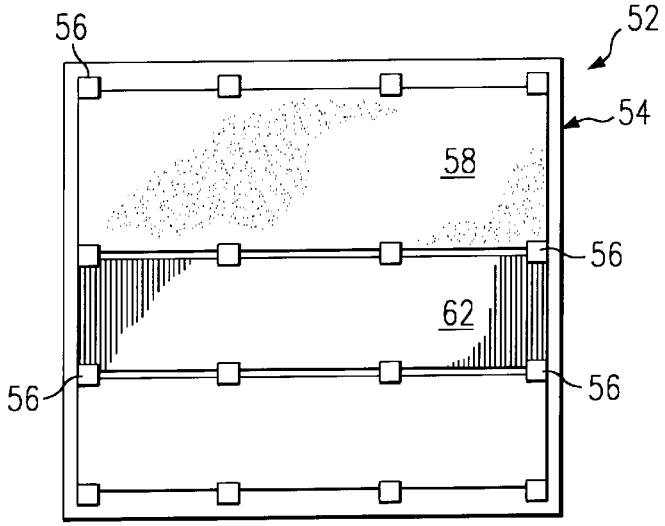
FIG. 6 provides a conceptual illustration of the various adhesive mechanisms for use in the preferred embodiment.
Figure 7:
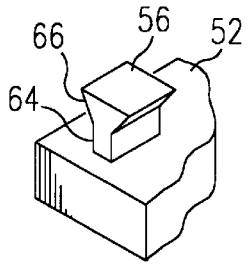
FIG. 7 shows the adhering mechanism attachment posts for use in the preferred embodiment.
Figure 8:
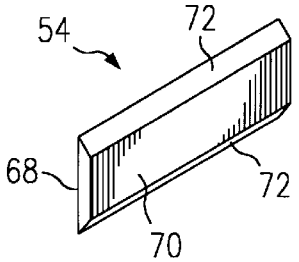
FIG. 8 provides a view of an adhesive panel for use with the preferred embodiment.

FIG. 6 shows the placement of adhering mechanisms 54 such as adhesive panel 58 and magnetic panel 62 on back side 52 of the preferred embodiment. As FIG. 6 illustrates, adhering mechanisms 54 fit by a friction fit between posts 56 that protrude from back side 52. FIG. 7 illustrates a possible form of post 56 for use with the preferred embodiment. Posts 56 include vertical surface 64 and slated surface 66 for receiving each of the adhering mechanisms such as adhesive tape panel 58 or magnetic panel 62. FIG. 8 shows an exemplary panel 54 to show the preferred shape of the adhering mechanism of the preferred embodiment. In essence, each of the panels would have a flat side 68 that is flush with the surface of back side 52 and an adhering surface, such as surface 70, that may be a sticky or tape surface such as that of adhesive panel 58. Alternatively, adhering surface 70 may be magnetic such as magnetic panel 62 or may be one of a wide variety of different surfaces that adheres to a recipient surface. The sides 72 of adhering mechanism 54 are symmetrical and associated to engage post 56 to permit a complementary friction fit. FIG. 9 also shows further examples for different embodiments for adhering mechanism 54. For example, adhering mechanism 54 may take the form of a clip panel 74 or hook panel 76.

FIG. 10 shows a possible embellishment of the preferred embodiment that includes case 80 for holding the various types of adhering panels or mechanisms 54 of the preferred embodiment. Thus, a sender knowing what type of surface on which he intends to adhere recording device 12 may simply select one or more of adhering panels 54 and use that panel for adhering recording device 12 to a surface. Although the preferred embodiment shows the use of three panels 54, the present invention certainly contemplates the use of multiple panels as well as a combination of different types of panels for adhering to different types of surfaces. Additionally, adhesive panels 54 may, in some instances, be advantageously adhered on top of one another for adapting the adhering mechanism of recording device 12 for particular types of surfaces.

Light-weight adhesive sound and note recording device 12 of the preferred embodiment has numerous technical advantages. For example, whereas exclusively handwritten notes limit the volume of information a note may express, the combination of the written text and audio sounds or recorded notes provide to the sender a much more complete way of expressing his or her thoughts.

Another advantage that the present invention of recording device 12 provides is the wide variety of adhering mechanisms that conventional notes or Post-it™ type notes do not provide. Thus, the sender may adhere recording device 12 to a smooth surface, a rough surface, a fabric surface, a magnetically responsive surface or a wide variety of other surfaces, that traditional Post-it™ notes or similar concepts cannot accommodate.

Another technical advantage of recording device 12 is that, because it permits recording sound, not only can the recipient interpret emphasis that the sender may express, but also the recipient gets a voice signature of the sender. Additionally, the sound and note recording device of the preferred embodiment effectively expresses sounds such as machine noises or sirens or other types of noises that written text simply cannot communicate well.

Another technical advantage of the present invention is that it has wide variety potential uses in addition to recording and communicating handwritten notes. For example, recording device 12 may be used as a business card or as an instruction label. Consider the scenario of a person using recording device 12 as a business card. It is clearly contemplated within the scope of the present invention that recording device 12 can be used to record a message to a potential customer, for example, and left with or for the customer. This adds a personal touch that conventional business cards simply cannot effectively provide.

As an instruction label, a user or manufacturer may position the preferred embodiment on a surface that will provide an audio set of instructions that the user would otherwise have to read in order to follow. One scenario in which this may be advantageous is, for example, in the use of a fire extinguisher. In this scenario, the user would be directed to press play button 30, for example. Upon pressing play button 30, the user would be directed in the steps necessary to properly use the fire extinguisher to put out a fire. This could substantially improve a person's effectiveness in fighting a fire, because the person would not have to take the time to read the instruction label to operate the fire extinguisher. The preferred embodiment would however, contemplate the written instructions on an associated surface such as flat surface 26. There are numerous other possible applications for combining the audio playback feature of the preferred embodiment with the written text or printed text that may be displayed on surface 26.

Yet a further technical advantage of the preferred embodiment of recording device 12 over similar technology can be seen in comparing recording device 12 to, for example, a voice mail system associated with a sender's telephone. Most voice mail systems are only located at a central location. Thus, in order to communicate with a voice mail system, one must have a telephone to reach the centralized location of the voice mail system. Recording device 12 of the preferred embodiment, on the other hand, is a separate and self-contained unit that is portable and that adheres to a wide variety of surfaces. The mobility of recording device 12, thus, provides significant advantages over the restricted centralized location of conventional voice mail systems. In a similar vein, when compared to conventional written note recording devices the preferred embodiment is advantageous because it does not require a pen or other writing utensil to leave a message. By simply pressing record button 28, a person may leave a message for the recipient who can later press play button 30 and receive the message.

One more technical advantage of the present invention is that it is fully recyclable. Handwritten notes and devices such as those of the Post-it™ note variety are wasteful in the sense that once they are used they are thrown away. The preferred embodiment of recording device 12, on the other hand, may be used repeatedly for recording and playing back messages between senders and recipients. Except for paper that optionally may be associated with the device such as paper for flat surface 26 of the preferred embodiment, the only part of recording device 12 that is expended upon the use is the power from the power source of battery pack 44. Thus, the preferred has significant environmental advantages.

The operation of the preferred embodiment of recording device 12 is clear once the association of its respective components is understood. However, for completeness, the following describes its various modes of operation. When a sender desires to leave a message, he may, for example, write on surface 26 whatever written message he desires and then begin recording his audio message. The recording begins by pressing record button 28 on the front of recording device 12. Control circuitry 36 will then operate integral software to detect when the person starts talking. Control circuit 36 compresses the voice data that it receives from microphone 34 through converter 42 and stores the compressed data in RAM 38. Once a period of silence is detected, for example, or the record button 28 is pressed again, control circuitry 36 de-energizes microphone circuit 34 and stops recording to RAM 38. The sender may then select the appropriate adhering mechanism or panel 54 and place the adhering mechanism on side panel 52 of device 12. Recording device 12 is then attached to the appropriate surface for the recipient to later pick up his message.

For the recipient to pick up the message, he merely reads whatever text appears on surface 26 and, then, presses play button 30 to hear the audio message. In a possible embodiment, if the recipient presses record button 28, recording device 12 may beep and continue to do so until the recipient presses play button 30 to listen to the recorded message. Playback occurs by control circuitry 36 reading the digital data from RAM 38 and sending it through digital-to analog converter 42 to piezo-electric speaker 40. Piezo-electric speaker 40 plays the analog-signal from converter 42 as an audible sound recording of the sender's message.

Other possible scenarios for use of the preferred embodiment include leaving a note for yourself such as a grocery list, recording a note for someone else to give them instructions such as the "Come see me" instruction 22 or the "Read your E-Mail" message 24 of FIGS. 1*a* and 1*b*. It may also be possible to record a single message on numerous recording devices 12 for distribution to a group of people to announce, for example, that they should meet together at a certain time.

In summary, there is provided a light-weight adhesive sound and written text recording device for recording sounds and attaching to numerous different types of surfaces that includes recording circuitry for receiving and recording various sounds as a set of digital signals. The device includes a memory circuit for storing the digital signals and speaker circuitry for playing the digital signals as recordings of the sounds. Control circuitry of the preferred embodiment controls operation of the recording device, the memory circuit, and the speaker circuitry for recording, storing, and playing back the sounds. A power source within the adhesive note recording device provides the necessary power for system operation and an associated adhering mechanism permits adhering the adhesive note recording device to a wide variety of surfaces. The recording device has a flat surface for note taking or printing other text or graphical design and is of sufficiently small size and mobility for repeated use as a personal note taking or note communication device.

Although the present invention has been described in detail, it should be understood that various changes, substitutions, and alterations may be made hereto without departing from the spirit and scope of the invention as defined by the appended claims.

What is claimed is:

1. A sound and note recording device for recording sounds and written text and attachable to different types of surfaces, comprises:

recording circuitry for receiving and recording sounds as a plurality of digital signals;

a memory circuit for storing said digital signals;

speaker circuitry for playing said digital signals as recordings of said sounds;

control circuitry to control operation of said recording circuitry, said memory, and said speaker circuitry;

a power source for providing power to operate said sound and note recording device;

a text surface for recording written text;

an adhering mechanism for adhering said sound and note recording device to a plurality of surfaces; and said sound and note recording device having sufficiently small size surface and weight for repeated use as a portable sound and note recording device attachable to different types of surfaces.

2. The apparatus of claim 1, wherein said recording circuitry comprises a microphone for receiving said sounds and converting said sounds to analog signals, and a converter for converting said analog signals to digital signals for communication to said memory circuit.

3. The apparatus of claim 1, wherein said control circuitry comprises an application specific integrated circuit for control of said recording circuitry, said memory circuit, and said speaker circuitry.

4. The apparatus of claim 1, wherein said adhering mechanism comprises an adhering panel associated to removably engage with said recording device.

5. The apparatus of claim 4, wherein said adhering panel comprises a magnetic panel for adhering said sound and note recording device to a metallic surface.

6. The apparatus of claim 4, wherein said adhering panel comprises a velcro panel for adhering said sound and note recording device to a fabric surface.

7. The apparatus of claim 4, wherein said adhering panel comprises an adhering clip for adhering said sound and note recording device to a surface capable of engaging with said adhering clip.

8. The apparatus of claim 1, wherein said speaker circuitry comprises a piezo-electric speaker associated with said control circuitry for playing said sounds.

9. The apparatus of claim 1, wherein said recording circuitry further comprises a record button associated with said recording circuitry and said control circuitry for controllably recording said sounds.

10. The apparatus of claim 1, wherein said speaker circuitry comprises a play button associated with said control circuitry for controlling said playing of said digital signals as recordings of said sounds.

11. A method for recording sounds and written text and attaching to different types of surfaces a small and light-weight sound and note recording device, comprising the steps of:

receiving and recording sounds as a plurality of digital signals in recording circuitry associated with said sound and note recording device;

storing said digital signals in a memory circuit;

playing said digital signals as recordings of said sounds with a speaker circuit within said recording device;

using control circuitry within said recording device to control operation of said recording circuit, said memory, and said speaker circuit;

providing power to operate said recording device from a power source within said recording device;

recording written text on a text surface of said recording device;

adhering said small and light-weight sound recording device to one of a plurality of different types of surfaces using an associated adhering mechanism; and packaging said recording device in a sufficiently small size surface for repeated use as a portable sound and note recording device attachable to different types of surfaces.

12. The method of claim 11, further comprising the step of receiving said sound using a microphone and converting said sounds to analog signals and said analog signals to digital signals for communication to said memory circuit.

13. The method of claim 11, further comprising the step of controlling operation of said recording circuit, said memory and said speaker circuit using an application specific integrated circuit.

14. The method of claim 11, wherein said adhering step further comprises the step of associating with said recording device an adhering panel that is associated for removable engagement of said recording device.

15. The method of claim 14, wherein said adhering a magnetic panel with said recording device for adhering said recording device to a metallic surface.

16. The method of claim 14, wherein said adhering a velcro panel with said recording device for adhering said recording device to a fabric surface.

17. The method of claim 14, wherein said adhering step further comprises the step of associating an adhering clip with said recording device for adhering said recording device to a surface capable of engaging with said adhering clip.

18. The method of claim 11, wherein said storing step further comprises the step of storing said digital signals in a random access memory.

19. The method of claim 11, wherein said recording step further comprises the step of associating a record button with said recording circuitry and said control circuitry for controllably recording said sounds.

20. The method of claim 11, wherein said playing step further comprises the step of associating a play button with said control circuitry for controlling said playing of said digital signals as recordings of said sounds.

21. The method of claim 11, wherein said control circuit forming step further comprises the step of forming an application specific integrated circuit for control of said recording circuitry, said memory circuit, and said speaker circuitry.

22. A method of providing a light-weight adhesive sound and note recording device for recording sounds and written text and attaching to a plurality of different types of surfaces, comprising the steps of:

providing a recording circuit for receiving and recording sounds as a plurality of digital signals;

providing a memory circuit for storing said digital signals;

providing a speaker circuit for playing said digital signals as recordings of said sounds;

providing a control circuit to control operation of said recording circuitry, said memory, and said speaker circuitry;

providing a power source to operate said recording device;

providing a text surface on said reading device for recording written text;

providing an adhering mechanism for adhering said light-weight adhesive sound recording device to a plurality of surfaces; and said light-weight adhesive recording device having sufficiently small size surface for repeated use as a portable and adhesive sound and note recording device.

23. The method of claim 22, wherein said recording circuit forming step further comprises the steps of forming a microphone for receiving said sound and converting said sounds to analog signals and forming a converter for converting said ananlog signal to digital signals for communication to said memory circuit.

24. The method of claim 22, wherein said recording circuit forming step further comprises the step of forming a record button associated with said recording circuitry and said control circuitry for controllable recording said sounds.

25. The method of claim 22, wherein said speaker circuit further comprises the step of forming a play button associated with said control circuitry for controlling said playing of said digital signals as recordings of said sounds.

* * * * *